US007111648B2

(12) United States Patent
Mitchell et al.

(10) Patent No.: US 7,111,648 B2
(45) Date of Patent: Sep. 26, 2006

(54) TERRY FABRIC AND METHOD FOR WEAVING SAME

(75) Inventors: Paul H. Mitchell, Fort Mill, SC (US); John V. Wirth, Fort Mill, SC (US)

(73) Assignee: Springs Industries, Inc., Fort Mill, SC (US)

( * ) Notice: Subject to any disclaimer, the term of this patent is extended or adjusted under 35 U.S.C. 154(b) by 284 days.

(21) Appl. No.: 10/778,872

(22) Filed: Feb. 13, 2004

(65) Prior Publication Data

US 2005/0178458 A1 Aug. 18, 2005

(51) Int. Cl.
*D03D 27/00* (2006.01)
*D03D 27/06* (2006.01)

(52) U.S. Cl. ..... 139/391; 139/396; 139/402; 139/404

(58) Field of Classification Search ..... 139/391, 139/396, 402, 404
See application file for complete search history.

(56) References Cited

U.S. PATENT DOCUMENTS 1,398,752 A * 11/1921 Taylor ..... 139/396
1,643,817 A * 9/1927 Lister ..... 139/403
1,830,892 A * 11/1931 Talbirt ..... 139/396
1,925,459 A * 9/1933 Parker et al. ..... 139/396
2,015,810 A * 10/1935 Morgan ..... 139/402
2,599,293 A * 6/1952 Symonds ..... 139/37
2,642,571 A * 6/1953 Brown ..... 2/97
2,989,992 A * 6/1961 Hoyer et al. ..... 139/387 R
4,714,096 A * 12/1987 Guay ..... 139/391
4,984,606 A * 1/1991 Moore et al. ..... 139/25
5,447,182 A * 9/1995 Gehrig ..... 139/396
6,253,797 B1 * 7/2001 Vogel et al. ..... 139/396

* cited by examiner

*Primary Examiner*—John J. Calvert
*Assistant Examiner*—Robert H. Muromoto
(74) *Attorney, Agent, or Firm*—Myers Bigel Sibley & Sajovec

(57) ABSTRACT

A terry fabric comprises a plurality of repeat units of interwoven warp and weft threads. Each of the repeat units comprises a set of ground warp threads, a set of pile warp threads, and a set of weft threads. The ground warp threads are woven tightly with the weft threads to form a substrate, and the pile warp threads are loosely interwoven with the weft threads to form pile loops. At least two adjacent weft threads are interwoven with the ground warp threads and the pile warp threads in an identical pattern (typically in a single machine cycle). In this configuration, fabrics with different properties can be producing in similar manufacturing duration, particularly if weft threads of different thread weight are employed.

26 Claims, 6 Drawing Sheets

TERRY FABRIC AND METHOD FOR WEAVING SAME

FIELD OF THE INVENTION

The present invention is directed generally to fabrics, and in particular to terry fabrics.

BACKGROUND OF THE INVENTION

Terry fabrics are very commonly used in numerous products, such as towels, robes and the like. Terry fabrics typically include within the fabric pile loops that provide texture, absorbency, softness, and other desirable properties to the fabric. The pile loops are interwoven with "ground" threads that serve as the base for the overall fabric. Loops may be incorporated into one or both sides of the fabric. Also, loops may be of different heights to provide a desired appearance or texture, and different colors or yarn types or sizes may also be employed to influence the look and properties of the fabric.

Terry fabrics are typically woven by employing two different types of warp threads that interweave with weft threads (also known as "picks"). "Ground" warps are interwoven with weft threads at a relatively high tension and form the base or substrate of the fabric. "Pile" warps are interwoven at a much lower tension and are advanced or "let off" from the loom beam at a higher rate of speed than the ground warp threads, and they are permitted to "float" over two or more adjacent picks. When all of the threads are "beat up" (i.e., pushed together with a bar or the like) at the conclusion of a weaving repeat, the pile threads form loops that extend away from the substrate. Common terry patterns include 3, 4, 5, 6 and 7 pick weaves; higher pick patterns are often avoided for cost reasons, so most terry fabric is woven with a three-pick repeat pattern.

This type of terry fabric pattern has been used for years, but can have some shortcomings. For example, it would be desirable to increase the weight of the fabric without increasing manufacturing time. Further, it would be desirable to impart different fabric qualities into terry fabrics without increasing manufacturing time, and/or to match the quality of current products while decreasing manufacturing time. Also, during use the pile loops can slip relative to the substrate, which can negatively impact the quality of the fabric.

SUMMARY OF THE INVENTION

The present invention can provide terry fabrics that address one or more of these issues. As a first aspect, embodiments of the present invention are directed to a terry fabric comprising a plurality of repeat units of interwoven warp and weft threads. Each of the repeat units comprises a set of ground warp threads, a set of pile warp threads, and a set of weft threads. The ground warp threads are woven tightly with the weft threads to form a substrate, and the pile warp threads are loosely interwoven with the weft threads to form pile loops. Adjacent weft threads are interwoven with the ground warp threads and the pile warp threads in an identical pattern (i.e., they comprise "multiple picks" and/or are "multiple-insertions" within the same machine cycle). In this configuration, fabrics with different properties can be produced in similar manufacturing duration, particularly if weft threads of different thread weight are employed.

As a second aspect, embodiments of the present invention are directed to a method of weaving a terry fabric. The method comprises the steps of: providing a set of ground warp threads and a set of pile warp threads on a loom; and interweaving the set of ground warp threads and the set of pile warp threads with a set of weft threads into a plurality of repeat units. During the interweaving step, the pile warp yarns are woven at a tension that induces the formation of pile loops. Also, some adjacent weft threads are woven together and simultaneously to follow the same weave pattern relative to the ground warp threads and pile warp threads. Because the weft threads that are woven together can vary (typically dependent on the desired fabric characteristics), this weaving method can enable the production of fabrics with different performance characteristics. In addition, this method can enable some conventional fabrics to be produced in fewer weaving steps or passes.

BRIEF DESCRIPTION OF THE INVENTION

Figure 2A:
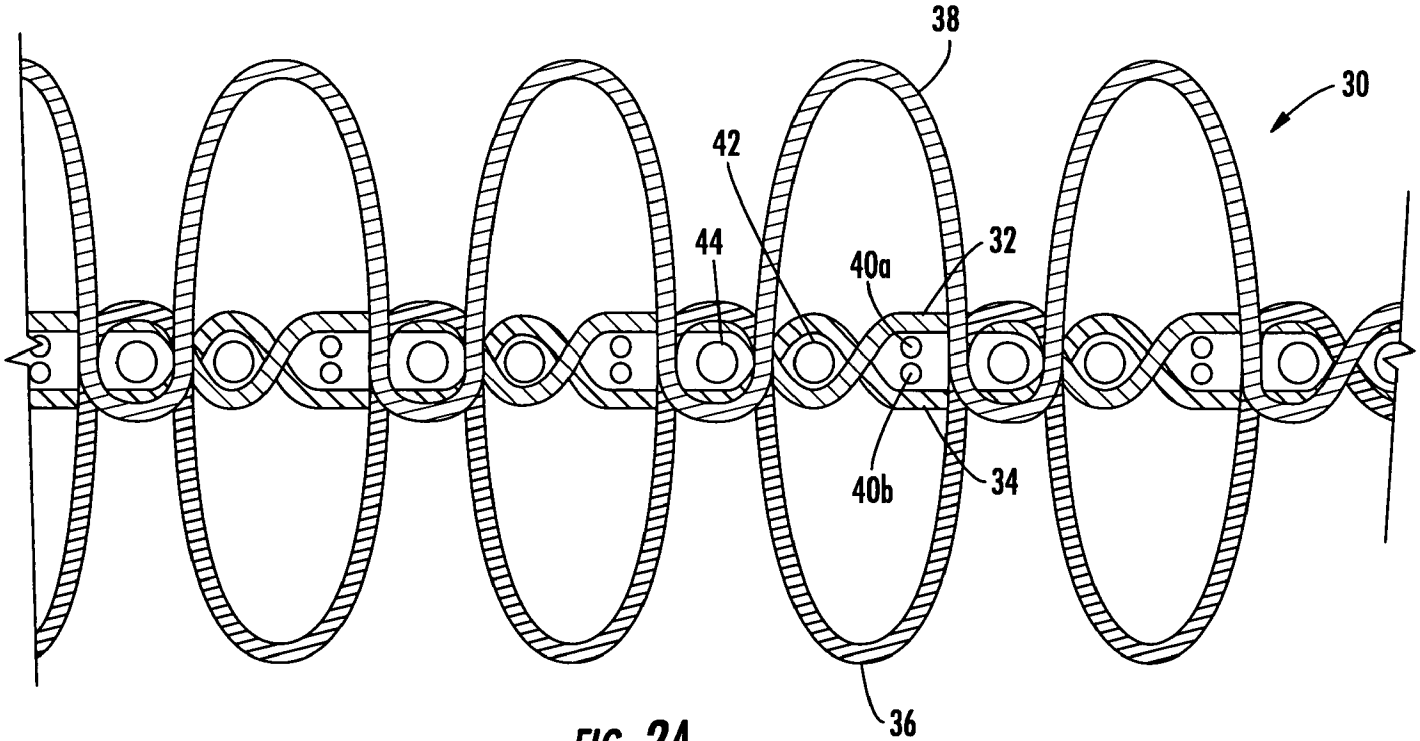
FIG. 2A is a schematic section view of a 4-pick terry fabric embodiment of the present invention showing exemplary ground warp and pile warp threads in side view and weft threads in section view.
Figure 2B:
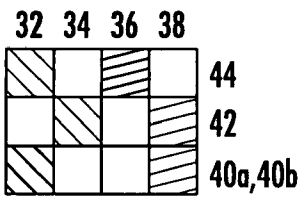

FIG. 2B is a production diagram showing a top view of the weave pattern of a repeat unit of the fabric of FIG. 2A, wherein the horizontal row labeled with two weft threads indicates a single weft pass of two "double-picked" weft threads. It is to be understood that this and subsequent weaving diagrams are exemplary or the order of draw of the warp threads and are not to be construed as limited to only the illustrated draw sequences.

Figure 2C:
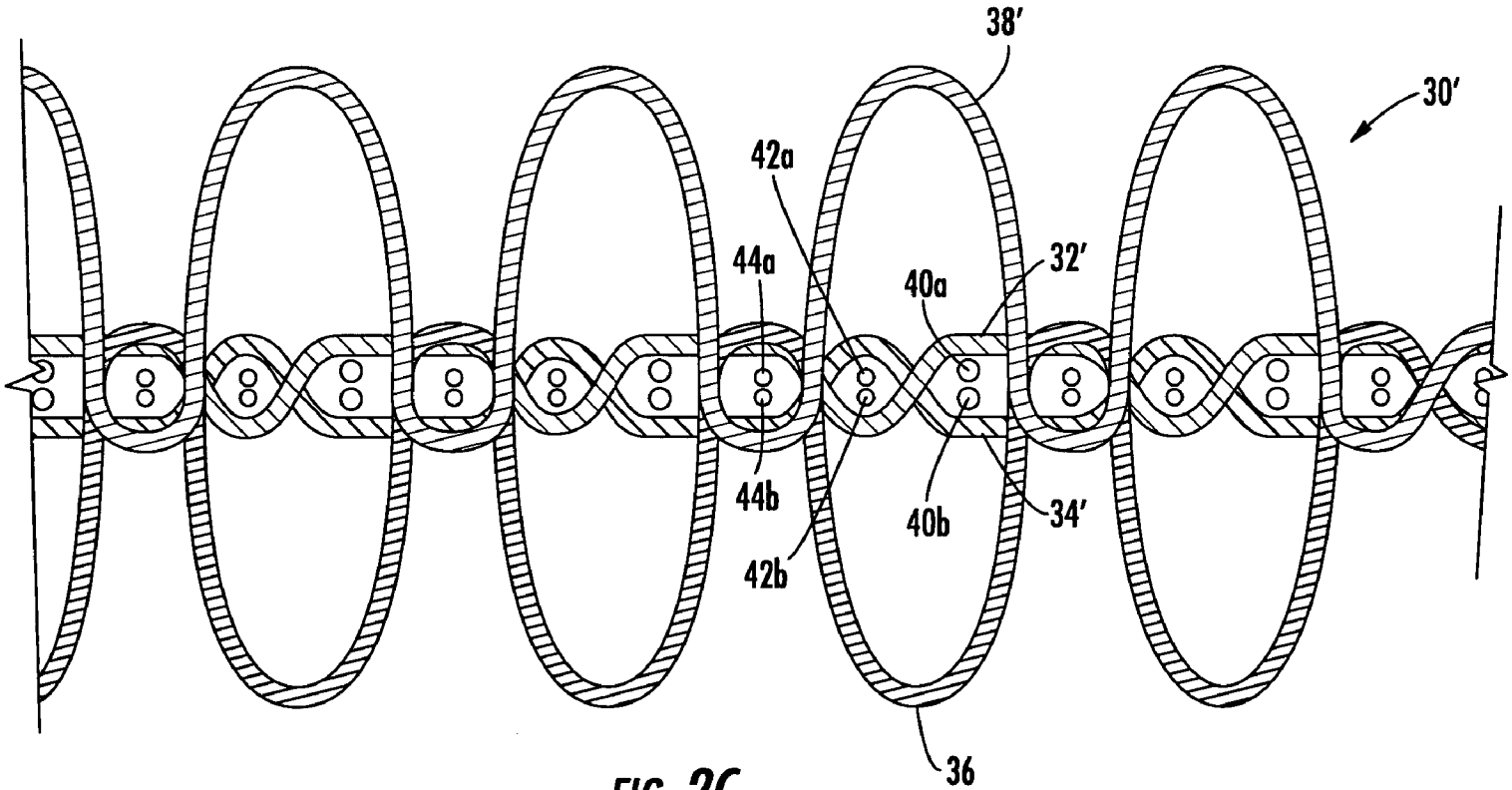

FIG. 2C is a schematic section view of a 6-pick terry fabric embodiment of the present invention showing exemplary ground warp and pile warp threads in side view and weft threads in section view.

Figure 2D:
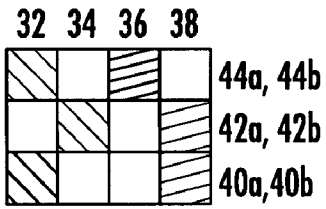

FIG. 2D is a production diagram showing a top view of the weave pattern of a repeat unit of the fabric of FIG. 2C, wherein each of the horizontal rows is labeled with two weft threads and indicates a single weft pass of two "double-picked" weft threads.

Figure 3A:
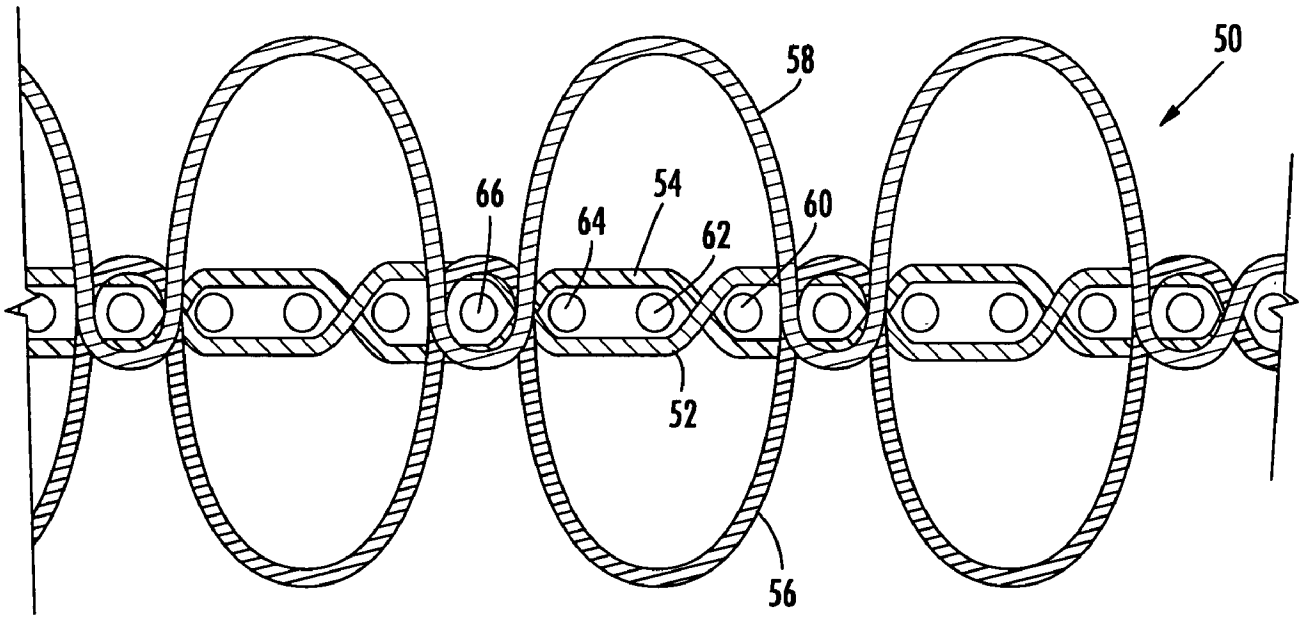

FIG. 3A is a schematic section view of a 4-pick terry fabric embodiment of the present invention showing exemplary ground warp and pile warp threads in side view and weft threads in section view.

Figure 3B:
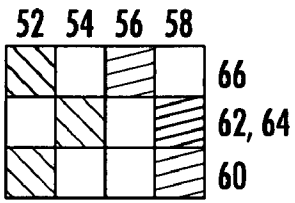

FIG. 3B is a production diagram showing a top view of the weave pattern of a repeat unit of the fabric of FIG. 3A, wherein the horizontal row labeled with two weft threads indicates a single weft pass of two "double-picked" weft threads.

Figure 4A:
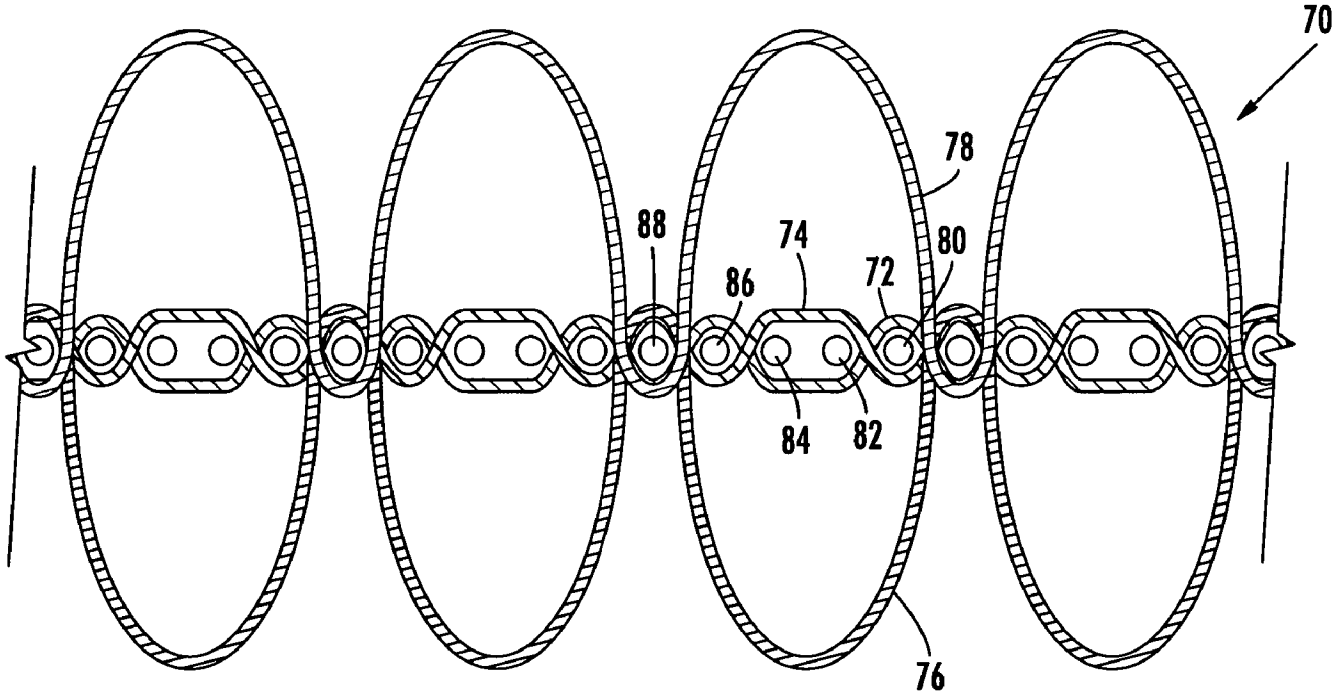

FIG. 4A is a schematic section view of a 5-pick terry fabric embodiment of the present invention showing exemplary ground warp and pile warp threads in side view and weft threads in section view.

Figure 4B:
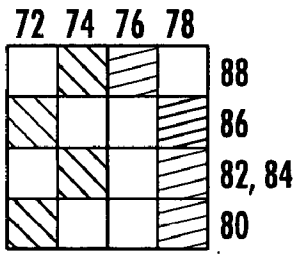

FIG. 4B is a diagram showing a top view of the weave pattern of a repeat unit of the fabric of FIG. 4A, wherein the horizontal row labeled with two weft threads indicates a single weft pass of two "double-picked" weft threads.

Figure 5B:
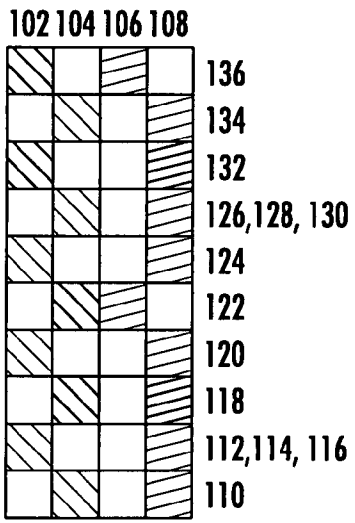
Figure 5A:
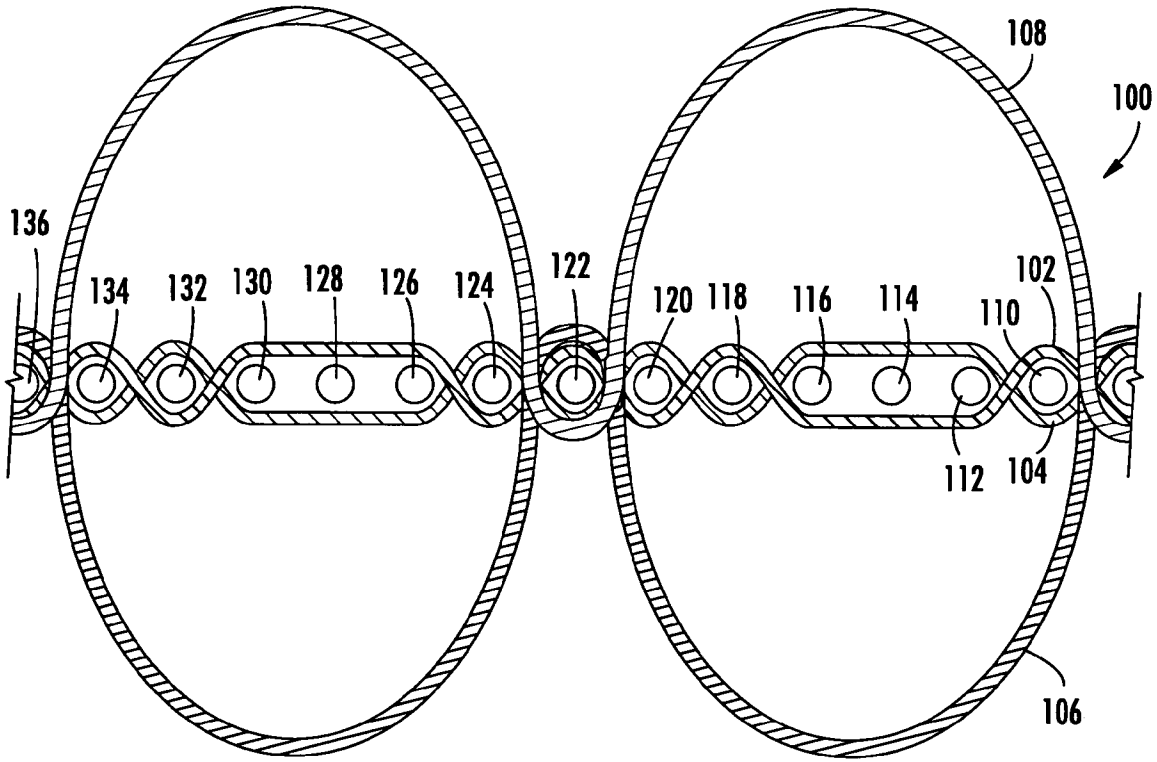

FIG. 5A is a schematic section view of a 7-pick terry fabric embodiment of the present invention showing exemplary ground warp and pile warp threads in side view and weft threads in section view.

FIG. 5B is a diagram showing a top view of the weave pattern of a repeat unit of the fabric of FIG. 5A, wherein the horizontal row labeled with three weft threads indicates a single weft pass of three "triple-picked" weft threads.

DETAILED DESCRIPTION OF EMBODIMENTS OF THE INVENTION

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity. It will be understood that when an element is referred to as being "attached", "connected" or "coupled" to another element, it can be directly connected or coupled to the other element or intervening elements may be present. In contrast, when an element is referred to as being "directly connected" or "directly coupled" to another element, there are no intervening elements present.

The present invention relates to terry fabrics and methods for weaving them. In the ensuing discussion, reference will be made to "repeat units" of a fabric, which represent a portion of a fabric that is repeated, typically multiple times, within the same expanse of fabric. It should be understood by those skilled in this art that some fabrics will contain only multiple repeat units of the fabrics, whereas other fabrics will contain both multiple repeat units as well as other stitching patterns.

Figure 1A:
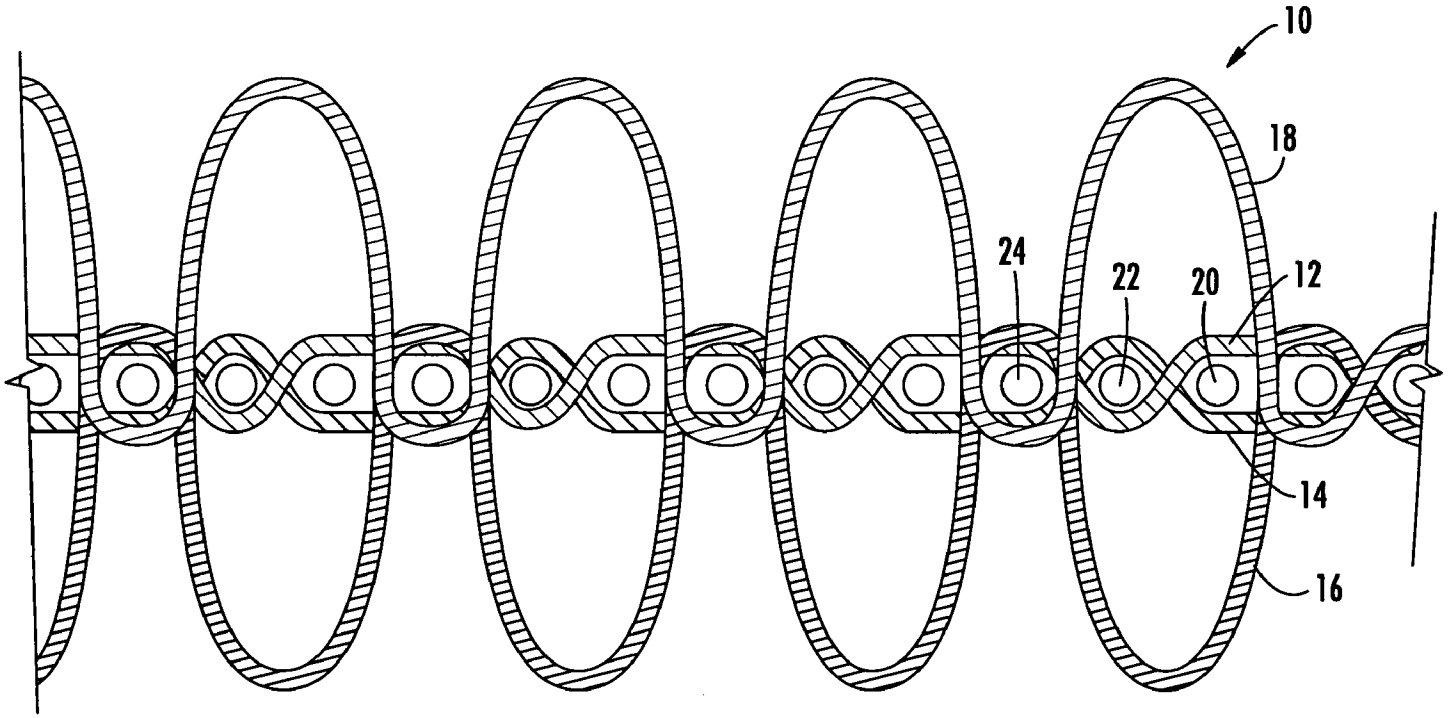
FIG. 1A (PRIOR ART)
FIG. 1A is a schematic section view of a prior art terry fabric showing exemplary ground warp and pile warp threads in side view and weft threads in section view.
Figure 1B:
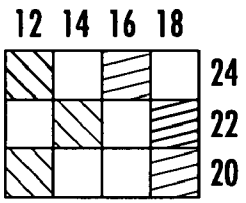
FIG. 1B (PRIOR ART)
FIG. 1B is a production diagram that shows a top view of the weave pattern of a repeat unit of the fabric of FIG. 1A, wherein cross-hatched boxes indicate points at which warp threads pass above intersecting weft threads, and wherein each horizontal row of boxes indicates one weft pass.

Referring now to the drawings, a prior art terry fabric weave, designated broadly at 10, is illustrated in FIGS. 1A and 1B. A repeat unit of the fabric 10 includes two ground warps 12, 14, two pile warps 16, 18, and three weft threads 20, 22, 24. As can be seen in FIG. 1A, the ground warps 12, 14 interweave tightly with the weft threads 20, 22, 24 in a 2:1 rib pattern. For example, the ground warp 12 passes above weft thread 20, below weft thread 22 and above weft thread 24, then repeats this pattern in subsequent repeat units. The ground warp 14 weaves alongside the ground warp 12 and passes below weft thread 20, above weft thread 22 and below weft thread 24. The pile warps 16, 18 also follow a 2:1 rib pattern in loosely interweaving with the weft threads 20, 22, 24; the pile warp 16 passes below weft threads 20, 22 and above weft thread 24, and the pile warp 18 passes above weft threads 20, 22 and below weft thread 24. Thus, the 2:1 rib pattern of the ground warps 12, 14 is offset from the 2:1 rib pattern of the pile warps 16, 18 by one weft thread.

The prior art fabric 10 can be contrasted with a repeat unit of an embodiment of a terry fabric of the present invention designated broadly at 30 and shown in FIGS. 2A and 2B. The fabric 30, much like the fabric 10, includes ground warps 32, 34 and pile warps 36, 38. The ground warps 32, 34 and pile warps 36, 38 are woven with four weft threads 40*a*, 40*b*, 42, 44 rather than the three weft threads of the fabric 10. The ground and pile warps 32, 34, 36, 38 interweave with the weft threads 40*a*, 40*b*, 42, 44 in the same manner as do the ground and pile warps of the fabric 10 described above with the exception that both of the weft threads 40*a*, 40*b* follow the same weave pattern as does the weft thread 20 of the fabric 10. Thus, the ground warp 32 weaves above the weft threads 40*a*, 40*b*, below the weft thread 42, and above the weft thread 44, while the group warp 34 weaves in the opposite pattern (i.e., below the weft threads 40*a*, 40*b*, above the weft thread 42, and below the weft thread 44). The pile warp 36 weaves below the weft threads 40*a*, 40*b*, 42 and above the weft thread 44, and the pile warp 38 weaves below the weft threads 40*a*, 40*b*, 42 and above the weft thread 44. Thus, both the ground warps 32, 34 and the pile warps 36, 38 weave with the weft threads 40*a*, 40*b*, 42, 44 in a 3:1 pattern. Those skilled in this art will recognize that, if the weft threads 40*a*, 40*b* are assumed to act as a single weft thread during weaving (as indicated in FIG. 2B), the weave pattern of the fabric 30 is identical to the weave pattern of the fabric 10. The weft threads 40*a*, 40*b* are illustrated in FIG. 2A as being vertically stacked, but they also may be woven side-by-side or in some other orientation in which they weave identically relative to the ground and pile warps 32, 34, 36, 38.

One potential benefit of the fabric 30 is that it can be woven using "double-pick" weaving technology. In double-pick weaving, two weft threads are interwoven with warp yarns simultaneously; the two weft threads necessarily will follow the same weaving pattern relative to the warp yarns. As a result, two weft threads can be woven in a single weaving step or pass, thus saving overall weaving time. Double-pick weaving is discussed in some detail in, e.g., *www.itt.edu* (the Internet site for the Institute of Textile Technology), as well as many other sources. Exemplary looms that can employ double-pick weaving are weaving machines available from Dornier GmbH, Lindau, Germany.

Comparing the fabric 30 to the prior art fabric 10, the fabric 30 can be woven in the same number of weaving steps or passes as the fabric 10, such that the manufacturing cost of the fabrics are similar. However, because two weft threads 40*a*, 40*b* can be inserted into positions ordinarily occupied by one weft thread 20, different properties can be imparted to the fabric 30. For example, and as illustrated in FIG. 2A, the weft threads 40*a*, 40*b* can be finer threads or yarns than are the weft threads 42, 44, with the result that a softer, more pliable fabric with more drape can result. Drape, resultant fabric weight, and/or cost and productivity of manufacturing can be impacted by selection of filling thread weight and/or the number of picks inserted simultaneously.

Typically, the threads of the fabric 30 will be formed of materials conventionally employed for terry fabrics, such as cotton, polyester and blends thereof. The diameter or weight of the thread should be selected based on the material comprising the thread and the type of fabric to be formed; exemplary thread diameters are between about 5/1 and 40/1 if the yams are plied. If at least one of the weft threads (such as weft threads 40*a*, 40*b* described above) is to differ from the other weft threads, its diameter may have a ratio of between about 0.3 and 3.0 to 1 compared to the diameter of the remaining weft threads.

Referring now to FIGS. 2C and 2D, a repeat unit of 6-pick terry fabric embodiment, designated broadly at 30', is illustrated therein. The weave pattern of the fabric 30' is similar to that of the fabric 30, with the exception that the ground warps 32, 34 and the pile warps 36, 38 are interwoven with three sets of double-picked weft yarns 40*a*', 40*b*', 42*a*', 42*b*', 44*a*', 44*b*' (as shown by FIG. 2D). This embodiment demonstrates that any or all of the weft yarns of the fabrics of the present invention can be woven as with multiple picks inserted simultaneously during one machine cycle (in this example double picking was used), and that ability to vary the fabric characteristics mentioned above for the fabric 30 can also be achieved, and in some instances further enhanced, by including additional multiple-inserted weft yams. As an additional example, a 9-pick fabric can be produced by inserting three weft threads in a triple-picking operation for each pair of double-picked threads in the fabric 30'.

Another example of how multiple insertions per machine cycle can assist in weaving a terry fabric is illustrated in FIGS. 3A and 3B. In this case double-picking is used in a 4-pick fabric 50 (one repeat unit is shown in FIGS. 3A and 3B). The fabric 50 includes ground warps 52, 54, pile warps 56, 58, and four weft threads 60, 62, 64, 66. The ground warp 52 weaves over the weft thread 60, under the weft threads 62, 64, and over the weft thread 66 in a 2:2 pattern. Conversely, the ground warp 54 weaves under the weft thread 60, over the weft threads 62, 64, and under the weft thread 66. The pile warp 58 passes over the weft threads 60, 62, 64 and under the weft thread 66 in a 3:1 pattern, and its opposing pile warp 56 passes under the weft threads 60, 62, 64 and over the weft thread 66.

It can be seen from the foregoing discussion and FIGS. 3A and 3B that the weft threads 62, 64 interweave identically with the ground and pile warps 52, 54, 56, 58. As such, the weft threads 62, 64 can be woven in a single weaving step or pass as a double pick (see FIG. 3B). If the weft threads 62, 64 are similar in diameter to the weft threads 60, 66, the weight of the fabric 50 (which typically increases its properties and, thus, its value) can be increased without adding to its manufacturing cost; in other words, the fabric 50 can have the weight of a conventional 4-pick terry fabric, but can be woven in the same duration (i.e., in the same number of weaving passes or steps) that a 3-pick terry fabric ordinarily could. As such, the same terry fabric can be produced for a lower manufacturing cost and can be endowed with different fabric characteristics. It should be noted that any weft thread shown in the diagram may be replaced by double, tripled, or other multiple pick insertions. For example, an 8-pick fabric can be produced by including double-picks for each of the weft threads of the fabric 50.

Similar gains can be realized for other terry fabric weaves. For example, a repeat unit of a 5-pick terry fabric 70 is illustrated in FIGS. 4A and 4B. The fabric 70 includes ground warps 72, 74 and pile warps 76, 78 as well as five weft threads 80, 82, 84, 86, 88. Each of the ground warps 72, 74 follows a 1:2:1:1 interweaving pattern with the five weft threads, and each of the pile warps follows a 4:1 weaving pattern. FIGS. 4A and 4B show that weft threads 82, 84 follow the identical weaving pattern relative to the ground and pile warps 72, 74, 76, 78. As such, the weft threads 82, 84 can be woven as double picks (see FIG. 4B). As a result, this 5-pick fabric can be woven with only four weaving steps or passes for every five weft threads, thereby enabling the weaving of a 5-pick fabric in the time ordinarily required for a 4-pick fabric. As with the earlier-discussed fabrics, any or all of the weft threads may be replaced with two or more weft threads that are multiple-inserted.

This concept is further demonstrated by a repeat unit of a 7-pick terry fabric 100 illustrated in FIGS. 5A and 5B. In the fabric 100, the ground warps 102, 104 and pile warps 106, 108 are interwoven with fourteen weft threads 110, 112, 114, 116, 118, 120, 122. The ground warps 102, 104 are interwoven with the weft threads in an opposing 1:3:1:1:1 pattern, and the pile warps 106, 108 are interwoven with the weft threads in an opposing 6:1 rib pattern. (Fourteen weft threads are included in the illustrated repeat unit because each of the ground warps 102, 104 follows one weaving sequence for seven weft threads, then follows the sequence of the other ground warp for the next seven weft threads; each of the pile warps 106, 108 repeats its sequence twice within the repeat unit—nevertheless, it is still commonly referred to as a 7-pick terry weave).As can be seen in FIGS. 5A and 5B, the weft threads 112, 114, 116 all follow the same path relative to the ground and pile warps 102, 104. 106, 108, as do the weft threads 126, 128, 130. Accordingly, two or three of the weft threads 112, 114, 116 can be woven via multiple pick insertion techniques, whether it be through triple pick weaving as shown for the fabric 100 (FIG. 5B shows weft threads 112, 114 and 116 being woven together in a triple-picking operation), or through a combination of double and single pick weaving in two steps. Other weft threads may also be replaced with multiple-inserted threads.

The discussion above regarding thread materials and diameters with respect to the fabric 30 of FIGS. 2A and 2B is equally applicable to all of the fabrics shown in FIGS. 3A–5B, as is the discussion of exemplary looms and other devices upon which the fabrics can be woven.

Those skilled in this art will also appreciate that certain features often found in terry fabrics, such as different patterns formed by pile loops of different heights and pick spacing, may also be employed in fabrics and methods of the present invention. It will also be understood that other terry fabric weave patterns may also be included in fabrics of the present invention. Moreover, it should be understood that some embodiments may enjoy both the production and fabric quality advantages discussed above. For example, a fabric may include two finer double-picked weft threads where one is typically woven, and may also include double-picked weft yams in locations where the interweaving pattern of the ground and pile loops enables two or more adjacent weft yarns to be woven together. In addition, it should be understood that multiple pick insertion can be utilized with terry fabrics whether it be double- or triple-picking as shown or other multiple-picked insertions.

The foregoing is illustrative of the present invention, and is not to be construed as limiting thereof. Although exemplary embodiments of this invention have been described, those skilled in the art will readily appreciate that many modifications are possible (including other multiple insertion techniques) in the exemplary embodiments without materially departing from the novel teachings and advantages of this invention. As such, all such modifications are intended to be included within the scope of this invention. The scope of the invention is to be defined by the following claims.

That which is claimed is:

1. A terry fabric, the fabric comprising a plurality of repeat units of interwoven warp and weft threads, each of the repeat units comprising:

a set of ground warp threads;

a set of pile warp threads; and a set of weft threads;

wherein the ground warp threads are woven tightly with the weft threads to form a substrate; and wherein the pile warp threads are loosely interwoven with the weft threads to form pile loops; and wherein some adjacent weft threads are interwoven with the ground warp threads and the pile warp threads in an identical pattern; and wherein at least one of the weft threads is of a different thread weight than the remaining weft threads in the set of weft threads.

2. The terry fabric defined in claim 1, wherein the repeat unit includes two ground warp threads and two pile warp threads.

3. The terry fabric defined in claim 2, wherein the set of weft threads comprises four weft threads.

4. The terry fabric defined in claim 1, wherein the pile warp threads and the weft threads interweave in a 3:1 pattern.

5. The terry fabric defined in claim 2, wherein the set of weft threads comprises ten weft threads.

6. The terry fabric defined in claim 5, wherein the ground warp threads and the weft threads interweave in a 1:2:1:1 pattern.

7. The terry fabric defined in claim 6, wherein the pile warp threads and the weft threads interweave in a 4:1:4:1 pattern.

8. The terry fabric defined in claim 2, wherein the set of weft threads comprises seven weft threads.

9. The terry fabric defined in claim 8, wherein the ground warp threads and the weft threads interweave in a 1:3:1:1:1 pattern.

10. The terry fabric defined in claim 9, wherein the pile warp threads and the weft threads interweave in a 6:1 pattern.

11. The terry fabric defined in claim 1, wherein the pile loop threads have a thread weight of between about $^{5}/_{1}$ and $^{40}/_{1}$.

12. A method for weaving a terry fabric, comprising the steps of:

providing a set of ground warp threads and a set of pile warp threads on a loom;

interweaving the set of ground warp threads and the set of pile warp threads with a set of weft threads into a plurality of repeat units;

wherein during the interweaving step, the pile warp yarns are woven at a tension that induces the formation of pile loops, and wherein some adjacent weft threads are woven together and simultaneously to follow the same weave pattern relative to the ground warp threads and pile warp threads; and wherein at least one of the weft threads is of a different thread weight than the remaining weft threads in the set of weft threads.

13. The method defined in claim 12, wherein the repeat unit includes two ground warp threads and two pile warp threads.

14. The method defined in claim 13, wherein the set of weft threads comprises four weft threads.

15. The method defined in claim 12, wherein the pile warp threads and the weft threads interweave in a 3:1 pattern.

16. The method defined in claim 13, wherein the set of weft threads comprises ten weft threads.

17. The method defined in claim 16, wherein the ground warp threads and the weft threads interweave in a 1:2:1:1 pattern.

18. The method defined in claim 17, wherein the pile warp threads and the weft threads interweave in a 4:1:4:1 pattern.

19. The method defined in claim 13, wherein the set of weft threads comprises seven weft threads.

20. The method defined in claim 19, wherein the ground warp threads and the weft threads interweave in a 1:3:1:1:1 pattern.

21. The method defined in claim 20, wherein the pile warp threads and the weft threads interweave in a 6:1 pattern.

22. The method defined in claim 12, wherein the pile loop threads have a thread weight of between about $^{5}/_{1}$ and $^{40}/_{1}$.

23. A method for weaving a terry fabric, comprising the steps of:

providing a set of ground warp threads and a set of pile warp threads on a loom;

interweaving the set of ground warp threads and the set of pile warp threads with a set of weft threads into a plurality of repeat units, wherein the set of weft threads includes weft threads of at least two different thread weights;

wherein during the interweaving step, the pile warp yarns are woven at a tension that induces the formation of pile loops, and wherein some adjacent weft threads of the same thread weight are woven together and simultaneously to follow the same weave pattern relative to the ground warp threads and pile warp threads.

24. The method defined in claim 23, wherein the repeat unit includes two ground warp threads and two pile warp threads.

25. The method defined in claim 24, wherein the set of weft threads comprises four weft threads.

26. The method defined in claim 25, wherein the pile warp threads and the weft threads interweave in a 3:1 pattern.

* * * * *